US006779877B2

(12) United States Patent
Andrews

(10) Patent No.: US 6,779,877 B2
(45) Date of Patent: Aug. 24, 2004

(54) INK JET PRINTHEAD HAVING A CHANNEL PLATE WITH INTEGRAL FILTER

(75) Inventor: John R. Andrews, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/195,333

(22) Filed: Jul. 15, 2002

(65) Prior Publication Data

US 2004/0008242 A1 Jan. 15, 2004

(51) Int. Cl.[7] ..... B41J 2/20
(52) U.S. Cl. ..... 347/65; 347/93
(58) Field of Search ..... 347/65, 93

(56) References Cited

U.S. PATENT DOCUMENTS

| | | | | |
|---|---|---|---|---|
| RE32,572 E | | 1/1988 | Hawkins et al. | 156/626 |
| 4,774,530 A | | 9/1988 | Hawkins | 347/63 |
| 4,864,329 A | | 9/1989 | Kneezel et al. | 347/93 |
| 5,124,717 A | | 6/1992 | Campanelli et al. | 347/93 |
| 5,141,596 A | | 8/1992 | Hawkins et al. | 216/2 |
| 5,154,815 A | | 10/1992 | O'Neill | 205/75 |
| 5,204,690 A | | 4/1993 | Lorenze, Jr. et al. | 347/93 |
| 5,686,224 A | | 11/1997 | O'Neill | 430/320 |
| 5,708,465 A | * | 1/1998 | Morita et al. | 347/65 |
| 5,734,399 A | * | 3/1998 | Weber et al. | 347/65 |
| 5,808,644 A | * | 9/1998 | Imamura et al. | 347/93 |
| 5,847,737 A | * | 12/1998 | Kaufman et al. | 347/94 |
| 6,045,214 A | * | 4/2000 | Murthy et al. | 347/47 |
| 6,081,280 A | | 6/2000 | Bolash et al. | 347/9 |
| 6,139,674 A | | 10/2000 | Markham et al. | 156/252 |
| 6,234,623 B1 | * | 5/2001 | Drake | 347/93 |
| 6,502,927 B2 | * | 1/2003 | Nozawa | 347/65 |

FOREIGN PATENT DOCUMENTS

EP 997 284 A2 * 5/2000 ..... B41J/2/14

* cited by examiner

*Primary Examiner*—Judy Nguyen
*Assistant Examiner*—Blaise Mouttet
(74) *Attorney, Agent, or Firm*—Fay, Sharpe, Fagan, Minnich & McKee, LLP

(57) ABSTRACT

A printhead for use in an ink jet printing device includes a heater substrate having a plurality of heating elements and an intermediate layer disposed adjacent the heater substrate. The intermediate layer defines a plurality of ink flow paths. A channel plate is disposed adjacent the intermediate layer and includes an integral filter having a plurality of filter teeth extending toward the intermediate layer. The channel plate defines an ink reservoir on one side of the integral filter and a cross-flow channel on a second side of the integral filter. Preferably, the channel plate, including the integral filter, comprises a single piece of plastic.

20 Claims, 5 Drawing Sheets

INK JET PRINTHEAD HAVING A CHANNEL PLATE WITH INTEGRAL FILTER

BACKGROUND OF THE INVENTION

The present invention relates to ink jet printers. It finds particular application in conjunction with an ink jet printhead having a channel plate with an integral filter, and will be described with particular reference thereto. It is to be appreciated, however, that the invention may find further application in conjunction with other ink jet technologies, such as piezo ink jet, as well as microfluid transport devices used in biological, chemical, and pharmaceutical applications.

In the area of microfluidics, fluid carrying components are small, often in the range of 500 microns down to 1 micron or smaller. Microfluid transport devices may be destroyed or debilitated by the inadvertent introduction of foreign particles into the fluid path, where the particles are large enough to block or seriously impede fluid flow in the device. This problem is magnified in systems where fluids are transported from the macroscopic world into microscopic componentry.

Conventional thermal ink jet printing systems use thermal energy pulses to produce vapor bubbles in an ink-filled chamber that expels droplets from channel orifices of the printing system's printhead. Such printheads include one or more ink-filled channels communicating at one end with a relatively small ink supply chamber or reservoir and having an orifice at the opposite end, commonly referred to as the nozzle. A thermal energy generator, typically a resistor, is located within the channels near the nozzle at a predetermined distance upstream therefrom. The resistors are individually addressed with a current pulse to momentarily vaporize the ink and form a bubble which expels an ink droplet. A meniscus is formed at each nozzle under a slight negative pressure to prevent ink from weeping therefrom.

Often, these thermal ink jet printheads are formed by mating two silicon substrates. One substrate, which is commonly referred to as a heater plate, contains an array of heater elements and associated electronics. The second substrate, which is commonly referred to as a channel plate, is a fluid directing portion containing a plurality of nozzle-defining channels and an ink inlet for providing ink from a source to the channels. The channel plate is typically fabricated by orientation dependent etching methods.

One of the problems associated with thermal ink jet technology is the sensitivity of ink droplet directionality to particulates in the ink. Print quality is directly related to accurate placement of the ink droplets on a recording medium and droplet directionality determines the accuracy of the ink droplet placement. Accordingly, filtration of the ink to prevent such particles from blocking the channels or nozzles is critical for good print quality. The dimensions of ink inlets to the die modules or substrates are much larger than the ink channels. Therefore, it is desirable to provide a filtering mechanism for filtering the ink at some point along the ink flow path from the ink manifold or manifold source to the ink channels. Any such filtering technique should also minimize air entrapment in the ink flow path. In order to provide better print resolution, channel and nozzle sizes have decreased, which places an even greater premium on ink filtration to eliminate yet smaller particles to maintain a given level of print quality.

Various devices and methods for reducing particle contamination have been employed. U.S. Pat. No. 4,864,329 to Kneezel et al. discloses a thermal ink jet printhead having a flat filter placed over the inlet thereof by a fabrication process, which laminates a wafer size filter to the aligned and bonded wafers containing a plurality of printheads. The individual printheads are obtained by a sectioning operation, which cuts through the two or more bonded wafers and the filter. The filter may be a woven mesh screen or, preferably, a nickel electroformed screen with a predetermined pore size. Because the filter covers one entire side of the printhead, a relatively large contact area prevents delamination and enables convenient leak-free sealing. However, electroformed screen filters having a pore size that is small enough to filter out particles of interest leads to filters that are very thin and subject to breakage during handling or wash steps. In addition, the preferred nickel embodiment is not compatible with certain inks, resulting in filter corrosion.

U.S. Pat. No. 6,139,674 to Markham et al. discloses a polyimide filter, formed of a laser-ablatable material, which is aligned and bonded to the ink inlet side of the substrate. In addition, U.S. Pat. No. 5,734,399 to Weber et al. discloses a particle filter within the photo polymer layer, that is, the layer that forms the channels or ink flow paths, which sits on top of the heater wafer. This filter includes a plurality of small pillars separated by a distance smaller than the smallest channel or nozzle dimension. However, these types of integral filters are inconvenient and somewhat ineffective for drop ejectors due to the tightly packed array of jets contained therein. Any filter with the same height as the jets, but with smaller openings, is going to exhibit a rather high ink flow impedance, which has an adverse effect on print quality.

The present invention contemplates a new and improved ink jet printhead having a plastic channel plate with an integral filter, which overcomes the above-referenced problems and others.

SUMMARY OF THE INVENTION

In accordance with one aspect of the present invention, a device for selectively applying droplets of at least one fluid to a medium includes an actuation layer for propelling droplets of fluid along a fluid path and an intermediate layer disposed adjacent the actuation layer. The intermediate layer defines a plurality of substantially parallel fluid flow channels extending along a first direction. A channel plate, which is disposed adjacent the intermediate layer, includes an integral filter having a plurality of filter elements extending toward the intermediate layer along a second direction perpendicular to the first direction.

In accordance with a more limited aspect of the present invention, the channel plate defines an fluid reservoir disposed on one side of the integral filter and a cross-flow channel disposed on a second side of the integral filter. The cross-flow channel extends along a third direction perpendicular to the first and second directions.

In accordance with another aspect of the present invention, an ink jet printhead includes a heater substrate having a plurality of heating elements and an intermediate layer, which defines a plurality of ink flow channels in fluid communication with a plurality of ink droplet emitting nozzles. A channel plate, which defines an ink reservoir, includes an integral filter disposed between the ink reservoir and the ink flow channels.

In accordance with another aspect of the present invention, a method of fabricating a printhead for use in an ink jet printing device includes the steps of providing a heater substrate having a plurality of heating elements and forming an intermediate layer over the heater substrate, where the intermediate layer defines a plurality of ink flow paths. The method further includes forming a plastic channel plate having at least one ink reservoir, an integral filter including a plurality of filter teeth, and at least one cross-flow channel. The channel plate is adhesively or mechanically secured to the intermediate layer.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
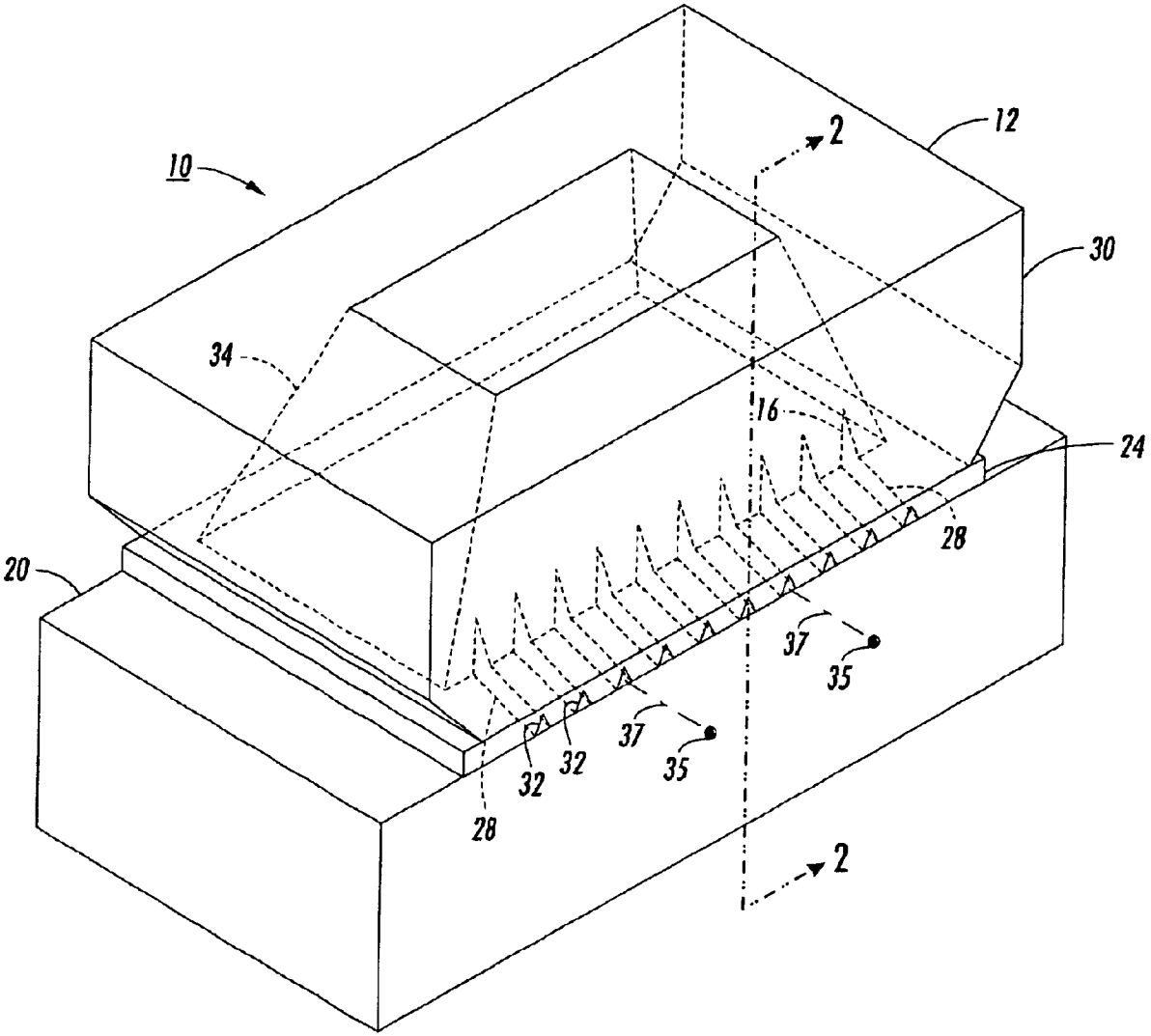
FIG. 1 is a partially shown perspective view of an ink jet printhead in accordance with the present invention.

Referring now to the drawings wherein the showings are made for purposes of illustrating preferred embodiments of the invention only and not for limiting the same, FIG. 1 shows a microfluid transport and ejection device, such as a thermal ink jet printhead 10, which includes a channel plate 12, having an integral filter 16, and a fluid actuation layer, such as a heater plate 20. A patterned film or intermediate layer 24, which is comprised of a material such as RISTON®, VACREL®, polyimide, SU-8, or the like, is sandwiched between the channel plate 12 and the heater plate 20, as shown. As is disclosed in U.S. Pat. No. 4,774,530 to Hawkins and incorporated herein by reference in its entirety, the intermediate layer 24 is etched or otherwise altered to remove material, thereby defining a plurality of substantially parallel fluid flow channels 28. The front face 30 of the printhead 10 contains a plurality of fluid droplet emitting nozzles 32, which are in fluid communication with a fluid reservoir 34 via the fluid flow channels 28. For illustration purposes, fluid droplets 35 are shown following trajectories 37 after ejection from nozzles 32 in the front face 30 of the printhead 10. While the present invention is being described in conjunction with a thermal ink jet printhead, it is to be appreciated that the present invention is applicable to a variety of microfluid transport and microfluid marking devices, which eject or otherwise deposit fluid droplets onto a medium. Such devices include, but are not limited to, piezo ink jet printheads, microfluid transport and metering devices for use in pharmaceutical delivery, analytical chemistry, microchemical reactors and synthesis, genetic engineering and the like.

Figure 2:
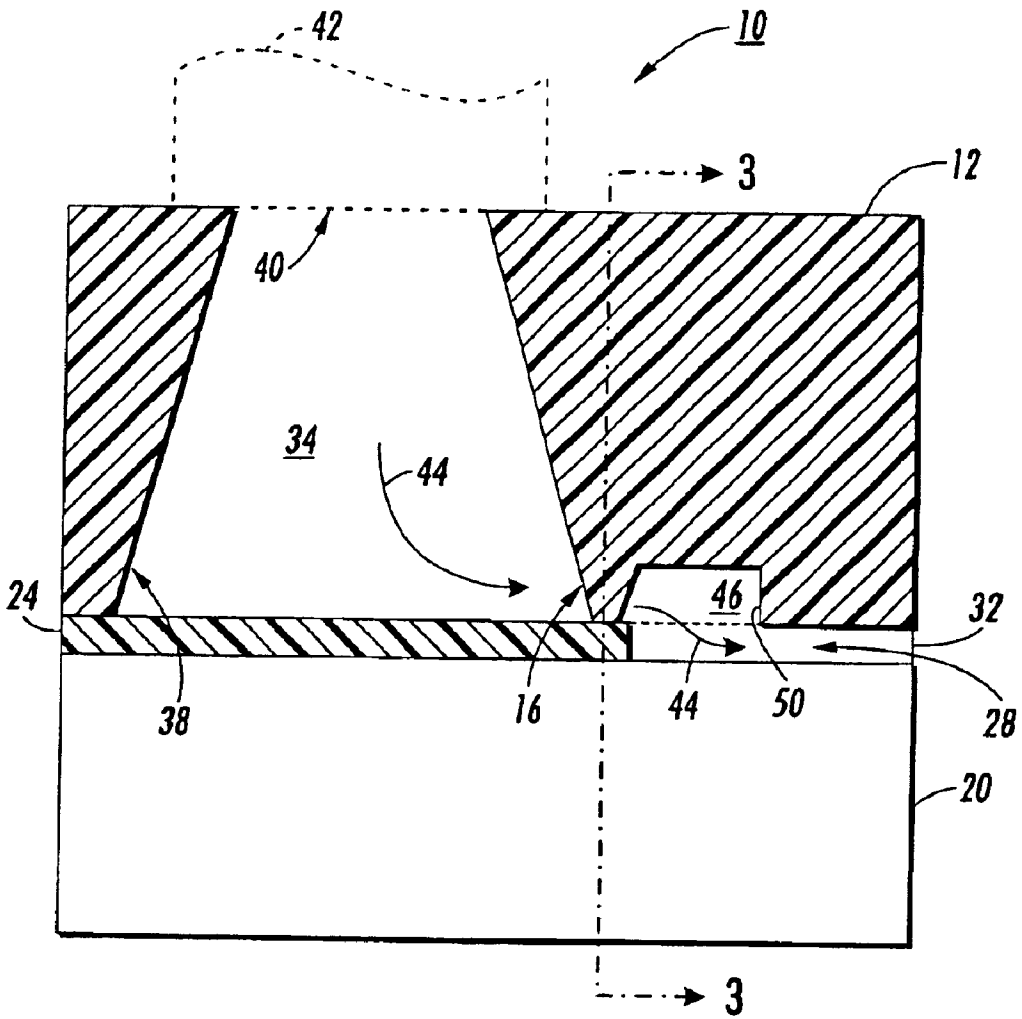
FIG. 2 is a cross-sectional view of the printhead of FIG. 1 as viewed along view line 2—2.

With reference to FIG. 2 and continued reference to FIG. 1, the channel plate 12, when mated to at least one of the intermediate layer 24 and heater plate 20, includes an etched recess, which defines the ink reservoir 34. More particularly, the ink reservoir 34 is defined at one end by a first surface 38 and at a second end by the integral filter 16. The channel plate 12 includes an ink inlet 40, which provides means for maintaining a supply of ink in the reservoir 34 from an ink supply source, such as an ink cartridge 42, partially shown in FIG. 2. Ink under a slight negative pressure enters through the ink inlet 40 in the channel plate 12 and fills the ink reservoir 34. By capillary action, the ink flows through the integral filter 16 and fills the ink flow paths or channels 28, as shown by directional arrows 44. Ink at each nozzle 32 forms a meniscus, preventing the ink from weeping or otherwise leaking out of the ink channel nozzles. As illustrated in FIG. 2, the channel plate 12 defines a cross-flow or rear channel 46. The cross-flow channel extends along a second direction perpendicular to the direction of the ink flow channels 28 and is in fluid communication with the plurality of ink flow channels. The cross-flow channel 46 is defined by a rear edge 50 at one end and by the integral filter 16 at a second end.

Preferably, the channel plate 12, including the integral filter 16, is formed of a plastic material, such as polyimide, polyurethane, polyvinyl acetate, Mylar, Upilex or another suitable polymeric material as known to those skilled in the art. The heater substrate is preferably constructed of silicon. Alternately, the channel plate may be a multi-layer structure, where some layers are silicon, ceramic, glass, steel or another metal, while the portion defining the integral filter is comprised of a plastic material. However, the materials are not limited to those identified and may include any of those known to one of ordinary skill in the art.

Figure 3:
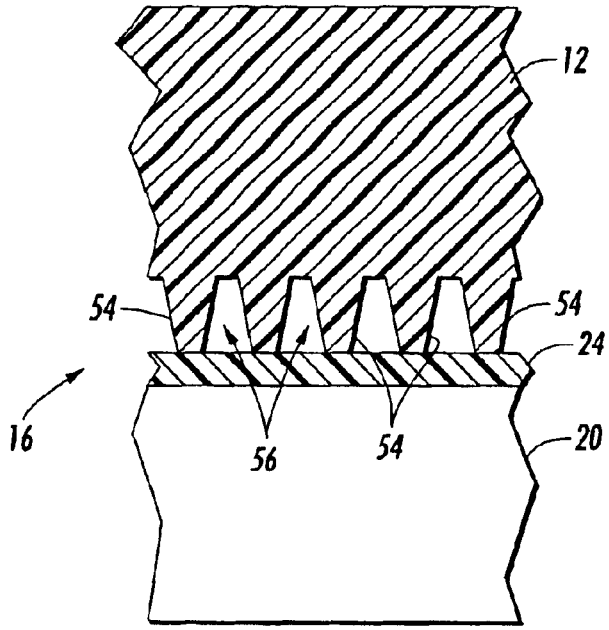
FIG. 3 is a cross-sectional view of the printhead of FIG. 2 as viewed along view line 3—3.
Figure 4:
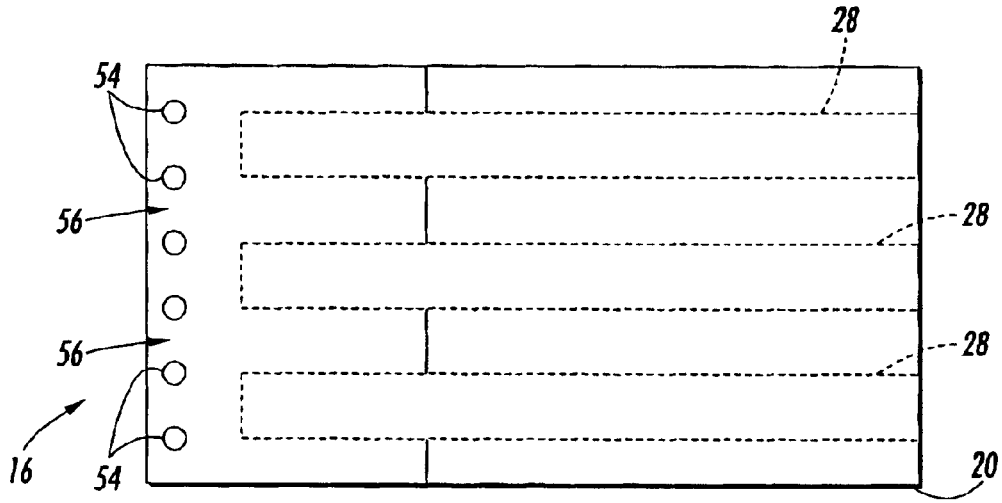
FIG. 4 is a top see-through view of a portion of the printhead of FIG. 2.

With reference to FIGS. 3 and 4 and continued reference to FIGS. 1 and 2, the integral filter 16 includes a plurality of filter elements or teeth 54, which extend toward the intermediate layer 24, as shown. The filter teeth 54 are disposed across the ink flow path 44 between the ink reservoir 34 and the cross-flow channel 46 in order to filter ink before it reaches the ink flow channels 28. In one embodiment, illustrated in FIG. 4, the filter teeth are disposed in a single row. However, as is discussed more fully below, the filter teeth may be arranged in a variety of configurations, thereby providing minimal ink flow resistance as well as enhanced ink filtration.

The filter teeth 54 of the integral filter 16 define a plurality of openings 56 therebetween. The size of the openings or separation distance between adjacent filter teeth 54 controls the integral filter's particle tolerance. In one embodiment, the height of the filter teeth 54 may be several times the separation distance between adjacent teeth, thereby minimizing ink flow resistance. In one embodiment, illustrated in FIGS. 3 and 4, the filter teeth 54 are substantially conical in shape, having substantially round cross-sections and sloping side walls, which define substantially triangular openings 56 between adjacent teeth. However, the filter teeth may assume a variety of other shapes, configurations, and geometries, including, but not limited to elliptical, square, triangular, rectangular, or otherwise polygonal and the like. In one exemplary embodiment in which the filter teeth have a wall slope of approximately 10 degrees, the openings between adjacent filter teeth are approximately 2.8 times the separation therebetween. In one color printhead embodiment in which the particle tolerance, that is the spacing between adjacent filter teeth, is approximately 11 $\mu$m, the height of the triangular openings between adjacent filter teeth is approximately 31 $\mu$m. In a black printhead embodiment in which the particle tolerance or filter size is approximately 15

μm, the maximum height of the triangular openings is approximately 42 μm. However, it is to be appreciated that other ratios of opening height to particle tolerance may be employed while still providing minimal ink flow resistance and filter efficacy.

Figure 5:
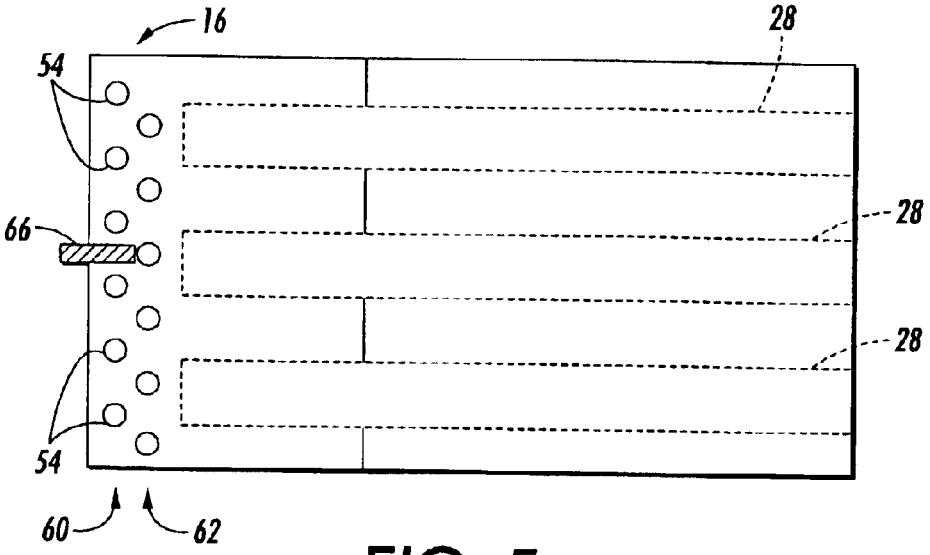
FIG. 5 is a top see-through view of an alternate embodiment of the printhead in accordance with the present invention.

As stated above, the filter teeth may be arranged in a variety of configurations to enhance ink filtration. For example, as illustrated in FIG. 5, the integral filter may include two or more staggered rows 60, 62 of filter teeth 54 making it particularly effective for trapping elongated particles 66. In this embodiment the two rows 60, 62 each contain a common number of filter teeth of a common size and shape with the second row 62 being offset or staggered relative to the first row 60. However, it is to be appreciated that the filter teeth within each row may be of differing size, shape, number, and spacing.

Figure 6:
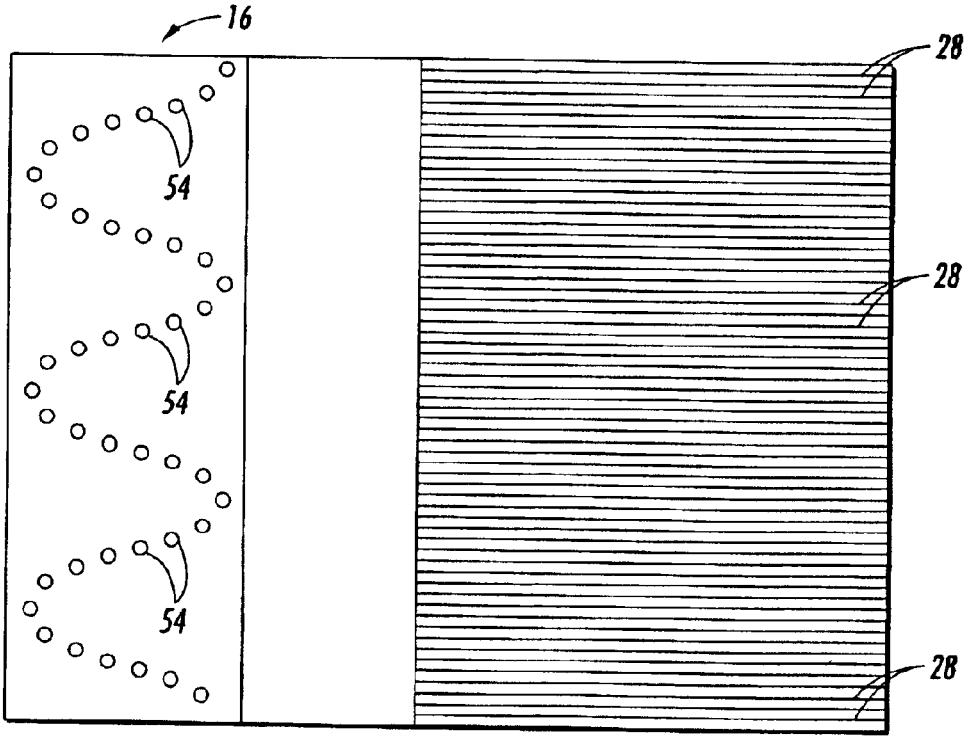
FIG. 6 is a top see-through view of another alternate embodiment of the printhead in accordance with the present invention.

In another embodiment, illustrated in FIG. 6, the filtration capacity of the integral filter 16 is further increased by increasing the length of the row of filter teeth 54. More particularly, the filter teeth are disposed in a non-linear configuration, such as a serpentine shape, sawtooth, sinusoid, or the like. This embodiment increases the number of openings between adjacent filter teeth by a factor of 1.4–1.6, which in turn, reduces the integral filter's ink flow resistance to the plurality of ink flow channels 28 by a comparable factor.

Figure 7:
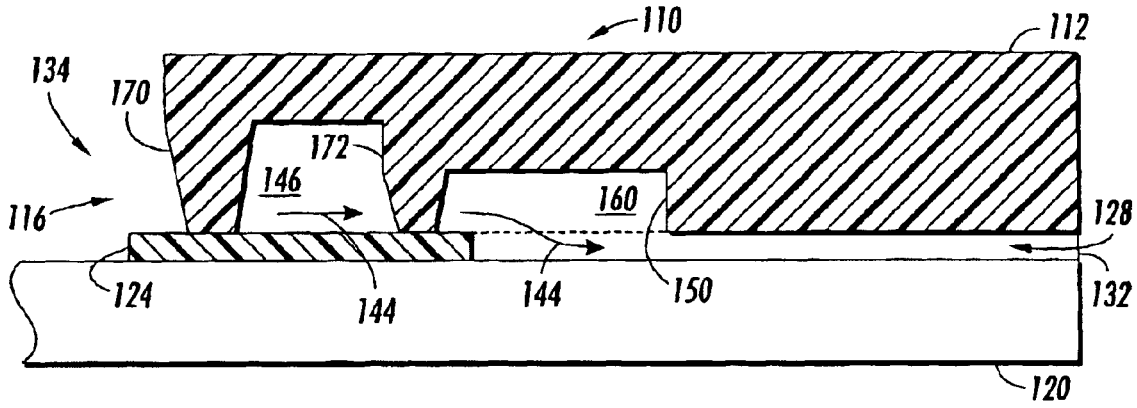
FIG. 7 is a cross-sectional view of an alternate embodiment of the printhead having a two-stage integral filter in accordance with the present invention.
Figure 8:
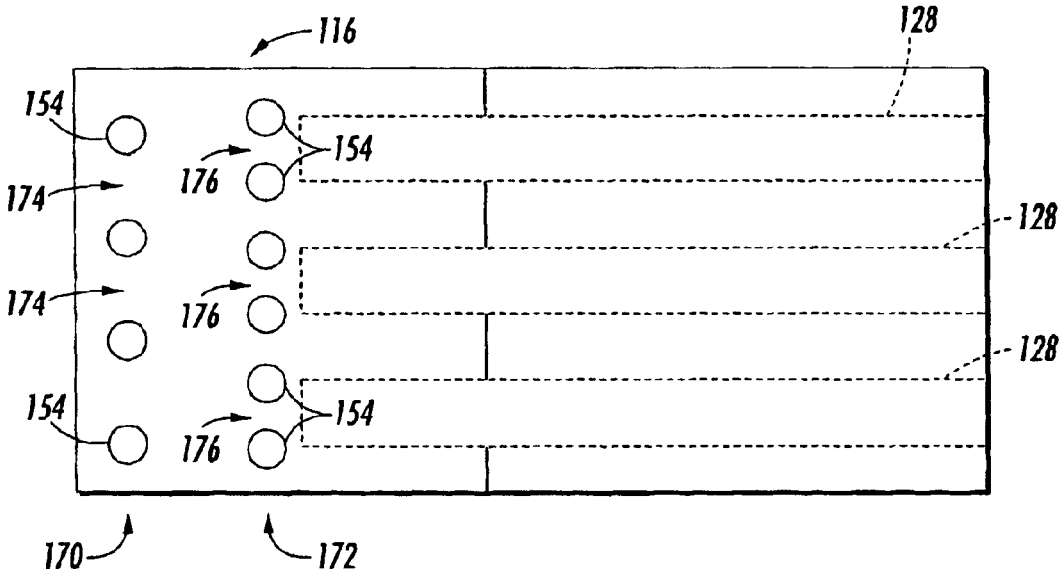
FIG. 8 is a top see-through view of a portion of the printhead of FIG. 7.

FIGS. 7 and 8 show an alternate embodiment of the printhead 110 having an integral filter 116. For convenience, components of the embodiment illustrated in FIGS. 7 and 8, which correspond to respective components of the embodiment illustrated in FIGS. 2 and 4, are given numerical references greater by one-hundred than the corresponding components in FIGS. 2 and 4. New components are designated by new numerals. In this embodiment, the printhead 110 includes a channel plate 112, having a two-stage integral filter 116, an intermediate layer 124, which defines a plurality of ink flow channels 128, and a heater plate 120. A plurality of droplet emitting nozzles 132 are in fluid communication with an ink reservoir 134 (partially shown) via the ink flow channels 128.

The two stage integral filter 116 includes a first stage or coarse filter 170 and a second stage or fine filter 172. Both the coarse filter 170 and the fine filter 172 include a plurality of filter elements or teeth 154, which extend toward the intermediate layer 124. Alternately, the integral filter may include more than two filter stages of varying particle tolerance. Further, the filter teeth within each stage may be of similar or different size, shape, number, and spacing. The filter teeth of the coarse and fine filters are disposed across the ink flow path 144, such that as ink passes through each stage of the integral filter, contaminants or other particulates are filtered out by the filter teeth. As discussed above, the filter's particle tolerance is controlled by the separation between adjacent filter teeth. More particularly, the coarse filter 170 includes a plurality a plurality of filter teeth 154, which define a plurality of openings 174 therebetween. Likewise, the fine filter includes a plurality of filter teeth 154, which define a plurality of openings 176 therebetween. In one embodiment, the openings between the filter teeth of the coarse filter 170 are approximately twice as wide as the openings between the filter teeth of the fine filter 172. It is to be appreciated that a plurality of opening ratios between the coarse and fine filters are contemplated. Further, as shown in FIG. 7, the filter teeth 154 of the coarse filter 170 are taller than those in the fine filter 172, and as such, make a smaller contribution to the overall ink flow resistance that those within the fine filter.

The channel plate 112 defines a pair of cross-flow channels 146, 160, which extend along a direction perpendicular to the direction of the ink flow channels 128. The first cross-flow channel 146, which is defined by the coarse filter 170 at one end and by the fine filter 172 at the other end, is not in direct fluid communication with the plurality of ink flow channels. The second cross-flow channel 160, which is defined by a rear edge 150 at one end and by the fine filter 172 at the other end, is in direct fluid communication with the plurality of ink flow channels. The two-stage filter mechanism of the integral filter 116, coupled with the two cross-flow channels 146, 160, facilitates increased particle tolerance by providing low overall ink flow resistance as well as enhanced ink filtration efficiency. The cross-flow channels 146, 160 eliminate high local resistance at individual ink flow channels 128 where a particle blocks one or more of the filter openings 174, 176.

Preferably, the channel plate 112, including the two-stage integral filter 116, is formed of a plastic material, such as polyimide, polyurethane, polyvinyl acetate, Mylar, Upilex or another suitable polymeric material as known to those skilled in the art. Alternately, the channel plate may be a multi-layer structure, where some layers are silicon, ceramic, glass, steel or another metal, while the portion defining the integral filters are comprised of a plastic material.

In one embodiment, the plastic channel plate, including the integral filter is fabricated using excimer laser ablation of a polymer piece, such as Upilex or the like, and adhesively bonded to the intermediate layer over the heater plate. As disclosed in U.S. Pat. No. 6,139,674 to Markham et al. and incorporated herein by reference in its entirety, output beams of varying size are generated by an excimer laser and directed toward a mask having a plurality of holes or other pattern. The radiation passing through the mask forms features, such as the filter teeth and cross-flow channels, within the channel plate. Alternately, the plastic channel plate, including the integral filter, may be formed or otherwise fabricated by molding, injection or otherwise, hot stamping and pressing of thermoplastics, polymer casting, and the like.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A device for selectively applying droplets of at least one fluid to a medium, said device comprising:

an actuation layer for propelling droplets of fluid along a fluid path;

an intermediate layer disposed adjacent the actuation layer, said intermediate layer defining a plurality of substantially parallel fluid flow channels extending along a first direction;

a channel plate disposed adjacent the intermediate layer, said channel plate including:

(i) an integral filter having a plurality of filter elements extending toward the intermediate layer, and further towards the heater plate, along a second direction perpendicular to the first direction, (ii) a fluid reservoir disposed on one side of the integral filter, and (iii) a cross-flow channel disposed on a second side of the integral filter, said cross-flow channel extending along a third direction perpendicular to the first and second directions, wherein said filter elements are disposed across the fluid path, which is further aligned with the intermediate layer, between the fluid reservoir and the cross-flow channel in order to filter fluid before it reaches the fluid flow channels.

2. The device as set forth in claim 1, wherein the actuation layer comprises a heater substrate having a plurality of heating elements.

3. The device as set forth in claim 1, wherein the cross-flow channel is in fluid communication with the plurality of fluid flow channels.

4. The device as set forth in claim 3, wherein the integral filter includes:

a single row of filter elements.

5. The device as set forth in claim 4, wherein adjacent ones of the filter elements are spaced apart by a separation distance.

6. The device as set forth in claim 5, wherein the filter elements have a height of at least twice the separation distance.

7. The device as set forth in claim 4, wherein the filter elements are substantially conical in shape.

8. The device as set forth in claim 3, wherein the integral filter includes a plurality of filter elements disposed in a non-linear configuration.

9. The device as set forth in claim 3, wherein the channel plate and integral filter are comprised of a plastic material.

10. The device as set forth in claim 3, wherein the integral filter includes at least two rows of filter elements, said first row of filter elements being offset along the third direction relative to the second row of filter elements.

11. The device as set forth in claim 1, wherein the integral filter includes a first row of filter elements and a second row of filter elements being offset along the first direction relative to the first row of filter elements.

12. The device as set forth in claim 11, wherein the channel plate defines:

(i) a fluid reservoir disposed on one side of the first row of filter elements;

(ii) a first cross-flow channel disposed between the first and second rows of filter elements, said first cross-flow channel extending along a third direction perpendicular to the first and second directions; and (iii) a second cross-flow channel disposed on one side of the second row of filter elements, said second cross-flow channel extending along the third direction.

13. The device as set forth in claim 12, wherein adjacent ones of the filter elements within the first row of filter elements are spaced apart by a first separation distance;

adjacent ones of the filter elements within the second row of filter elements are spaced apart by a second separation distance; and the first separation distance is at least as large as the second separation distance.

14. An ink jet printhead having a heater substrate including a plurality of heating elements, an intermediate layer which defines a plurality of ink flow channels in fluid communication with a plurality of ink droplet emitting nozzles, and a channel plate comprised of plastic which defines an ink reservoir, said channel plate including:

an integral filter, comprised of plastic, disposed between the ink reservoir and the ink flow channels, and having a plurality of filter teeth extending toward the intermediate layer, wherein the channel plate defines a cross-flow channel disposed between the integral filter and the ink flow channels, said cross-flow channel extending along a direction substantially parallel to the ink reservoir.

15. The ink jet printhead according to claim 14, wherein the integral filter includes at least two rows of filter teeth.

16. The ink jet printhead according to claim 15, wherein the filter teeth within the first row are spaced to filter particles of a given size; and the filter teeth within the second row are spaced to filter particles not larger than the given size.

17. A device for selectively applying droplets of at least one fluid to a medium, said device comprising:

an actuation layer for propelling droplets of fluid along a fluid path;

an intermediate layer disposed adjacent the actuation layer, said intermediate layer defining a plurality of substantially parallel fluid flow channels extending along a first direction;

a channel plate disposed adjacent the intermediate layer, said channel plate including an integral filter having a plurality of filter elements, wherein the filter elements within a first row of filter elements are taller than the filter elements within a second row of filter elements, extending toward the intermediate layer along a second direction perpendicular to the first direction.

18. The device as set forth in claim 17, wherein the integral filter includes the first row of filter elements and the second row of filter elements being offset along the first direction relative to the first row of filter elements.

19. The device as set forth in claim 18, wherein the channel plate defines:

(i) a fluid reservoir disposed on one side of the first row of filter elements;

(ii) a first cross-flow channel disposed between the first and second rows of filter elements, said first cross-flow channel extending along a third direction perpendicular to the first and second directions; and (iii) a second cross-flow channel disposed on one side of the second row of filter elements, said second cross-flow channel extending along the third direction.

20. The device as set forth in claim 19, wherein:

adjacent ones of the filter elements within the first row of filter elements are spaced apart by a first separation distance;

adjacent ones of the filter elements within the second row of filter elements are spaced apart by a second separation distance; and the first separation distance is at least as large as the second separation distance.

* * * * *